US006468393B1

(12) United States Patent
Small et al.

(10) Patent No.: US 6,468,393 B1
(45) Date of Patent: Oct. 22, 2002

(54) PATTERNED PAPER

(75) Inventors: Edward Charles Small, Aberdeen (GB); Brian Edward Evans, Kintore (GB)

(73) Assignee: Arjo Wiggins Fine Papers Limited (GB)

( * ) Notice: Subject to any disclaimer, the term of this patent is extended or adjusted under 35 U.S.C. 154(b) by 0 days.

(21) Appl. No.: 08/976,158

(22) Filed: Nov. 21, 1997

Related U.S. Application Data

(62) Division of application No. 08/434,538, filed on May 4, 1995, now Pat. No. 5,690,789.

(30) Foreign Application Priority Data

May 7, 1994 (GB) ..... 9409106
May 7, 1994 (GB) ..... 9409107

(51) Int. Cl.[7] ..... D21F 11/00

(52) U.S. Cl. ..... 162/134; 162/183; 162/169; 162/140; 428/211

(58) Field of Search ..... 162/140, 134, 162/169, 183, 126, 185; 428/195, 211; 283/72, 85, 113

(56) References Cited

U.S. PATENT DOCUMENTS

| | | | | | |
|---|---|---|---|---|---|
| 447,336 | A | * | 3/1891 | Macdonough | 162/140 |
| 491,858 | A | * | 2/1893 | Schlumberger | 162/140 |
| 1,623,620 | A | | 5/1927 | Dodman | |
| 1,724,522 | A | * | 8/1929 | Serebrianoi | 162/102 |
| 2,474,801 | A | | 6/1949 | Owen | |
| 2,666,699 | A | | 1/1954 | McQuiston et al. | |
| 2,698,788 | A | | 1/1955 | Greenman et al. | |
| 2,769,711 | A | | 11/1956 | Wilson | |
| 2,772,970 | A | | 12/1956 | Feigley | |
| 2,807,543 | A | | 9/1957 | McQuiston | |
| 2,843,479 | A | | 7/1958 | Piersol | |
| 2,880,090 | A | | 3/1959 | Feigley, Jr. | |
| 2,887,431 | A | | 5/1959 | Piersol | |
| 2,905,583 | A | | 9/1959 | Feigley, Jr. | |
| 3,766,002 | A | | 10/1973 | Greif et al. | |
| 4,121,966 | A | | 10/1978 | Amano et al. | |
| 4,189,345 | A | | 2/1980 | Foster et al. | |
| 4,378,272 | A | | 3/1983 | Suwala et al. | |
| 4,773,602 | A | | 9/1988 | Rossler | |
| 5,472,569 | A | | 12/1995 | Nicolucci et al. | |
| 5,567,275 | A | | 10/1996 | Nicolucci et al. | |

FOREIGN PATENT DOCUMENTS

| | | | |
|---|---|---|---|
| EP | 0342929 | | 11/1989 |
| EP | 525790 | | 2/1993 |
| EP | 0554659 | * | 8/1993 |
| EP | 565920 | | 10/1993 |
| EP | 0580363 | | 1/1994 |
| GB | 237828 | | 8/1925 |
| GB | 239880 | | 5/1926 |
| GB | 239879 | | 8/1926 |
| GB | 331707 | | 7/1930 |
| GB | 499434 | | 1/1939 |
| GB | 1000049 | | 8/1965 |
| GB | 1107341 | | 3/1968 |
| JP | 01162899 | | 6/1989 |

OTHER PUBLICATIONS

Patent Abstracts of Japan, vol. 018, No. 533 (C–1259), Oct. 11, 1994.

Patent Abstracts of Japan, vol. 017, No. 135 (C–1037), Mar. 19, 1993.

"Mottled effect paper for stationery and packaging". Paper Europe, Mar. 1994, p. 19.

* cited by examiner

*Primary Examiner*—Jose Fortuna
(74) *Attorney, Agent, or Firm*—Burns, Doane, Swecker & Mathis, L.L.P.

(57) ABSTRACT

Speckle-patterned paper is produced on the paper machine without the use of printing techniques by first preparing speckle-forming material and then introducing this into a contrasting color papermaking furnish. Paper is then made from the speckle-containing furnish in the normal way. The speckle-forming material is produced either by agglomerating a mixture of papermaking fibre, particulate pigment and, preferably, a latex or other binder or by dry comminution of cellulose fibre aggregates in the form of paper or entangled fibre clumps.

4 Claims, No Drawings

PATTERNED PAPER

This application is a divisional, of application Ser. No. 08/434.538, filed May 4, 1995 now U.S. Pat. No. 5,690,789.

BACKGROUND OF THE INVENTION

This invention relates to the production, on the paper machine, of paper which is patterned in contrasting colours without the use of printing techniques. Papers of this general kind are commercially available from Arjo Wiggins Limited under the trademark COUNTRYSIDE and are typically used when it is desired to impart distinctive aesthetic appeal to products such as brochures, folders, menus, invitations, and stationery. Although the paper is patterned during its production on the paper machine, it can be overprinted if desired to give additional decorative effects.

The pattern is introduced into the paper by the incorporation in the papermaking furnish of inclusions which contrast in appearance with the papermaking fibres which make up the bulk of the finished paper. The contrast in appearance arises as a result of the papermaking fibres being of a contrasting colour, shade or hue from that of the inclusions. For example, the papermaking fibres can be coloured and the inclusions white or vice versa. Alternatively both the papermaking fibres and the inclusions can be coloured, provided that the contrast between their colours is adequate.

Suitable inclusions are long contrasting-colour fibres of the kind known in the paper industry as "Silurian fibres", which impart a mineral or rock-like appearance to the paper; planchettes of contrasting appearance to the paper itself; or dark coloured particulate or fibrous material, which imparts a dark-speckled effect.

Just as dark-coloured inclusions give a dark-speckled effect, a white- or colour-speckled effect can be achieved by the addition to the papermaking furnish of small pieces of partially wet-disintegrated white or coloured paper (or, in principle, other material). The wet-disintegration can be carried out in a hydropulper or other apparatus of the kind used to disintegrate pulp bales at the start of the papermaking process (the starting paper must be a wet-strengthened or water-resistant coated paper, or else it will disintegrate to such an extent that it will not produce suitable speckles). Whilst a speckled paper produced in this way is fairly distinctive, the speckles lack sharpness, and hence the aesthetic appeal is not as great as desirable.

It is an object of the present invention to provide a method of making patterned paper with a white- or colour-speckled effect in which the speckles are of generally random size and shape and are sharp and well-defined, and which consequently has an attractive appearance.

SUMMARY OF THE INVENTION

We have now found that the key to achievement of this objective lies in the manner in which the speckle-forming material is produced. Specifically, we have found that suitable speckle-forming material can be formed by pre-agglomerating a mixture of papermaking fibre, particulate pigment and a binder, or by dry comminution of cellulose fibre aggregates. These starting aggregates can be in the form of paper, or of clumps of entangled fibres such as are obtained on breaking up bales of papermaking or other fibre pulp, and need not consist entirely of cellulose fibre. Dry comminution as just referred to is to be contrasted with wet disintegration as described above.

Accordingly, the present invention provides a process for the production of speckle- or similarly-patterned paper, said process comprising the steps of:

(1) preparing speckle-forming material by either
  (A) agglomerating a mixture of papermaking fibre, particulate pigment and, preferably, a latex or other binder, by the addition to the mixture of one or more flocculants, coagulants or other agglomerating agents ("Process Variant A"); or
  (B) dry comminution of cellulose fibre aggregates ("Process Variant B")

(2) introducing the resulting speckle-forming material into a papermaking furnish of which the fibres are of a contrasting colour to that of the speckle-forming material and on which dye, if present, has been fully fixed; and (3) draining the speckle-containing furnish to produce a patterned paper web.

The invention also extends to the patterned paper so produced and to the production of speckle-forming material for use in the process.

DETAILED DESCRIPTION OF THE PREFERRED EMBODIMENTS

The term "paper" in this specification includes heavy-weight papers of the kind often referred to as "boards".

Of the two process variants set out above, we have so far found Process Variant A to be preferred.

The speckles in the final paper product are of varying dimensions, being of generally random size and shape (in contrast to conventional planchettes). They are generally elongate or fibrous in appearance (particularly when produced by Process Variant A), and appear sharp and well-defined, the whole giving an attractive decorative effect. The speckle-forming material can be white or coloured. If the latter, the colour can be the result of the use of coloured starting materials. Alternatively, the speckle-forming material can be dyed during or after its production. When dye is used, it should desirably be fully-fixed before the speckle-forming material is mixed with the papermaking furnish.

The presence of fibres in the speckles is thought to assist in anchoring the speckles in the paper, since the speckle fibres can bond chemically and mechanically with the other fibres in the normal way.

The speckle-forming material is introduced to the furnish at a point close to the headbox of the papermaking machine, in order that the agglomerated or comminuted material is not re-dispersed or otherwise adversely affected by conditions of heavy shear and is not removed from the furnish altogether (as might happen, for example, if the agglomerated or comminuted material were introduced prior to a stock cleaning operation). It is important that any dye present should be fully fixed before addition of the speckle-forming material, as otherwise the speckle-forming material might itself become dyed to a colour similar to that of the background paper.

In Process Variant A, the agglomerating agent is typically a material of the kind used in the paper industry for increasing retention of fibre fines and/or fillers on the papermaking wire, i.e. a so-called retention aid, or a flocculant of the kind used to promote sedimentation in waste water treatment in the paper or other industries. The agglomerating agent can be termed either a flocculant or a coagulant (usage of these expressions in the paper industry tends to be imprecise).

Preferably, a combination of oppositely-charged agglomerating agents is used to generate an enhanced agglomerating action and thereby agglomerate said mixture.

In a preferred embodiment of Process Variant A, the fibre and pigment to be agglomerated are mixed in aqueous suspension, together with a suitable latex, for example a styrene-acrylic or styrene-butadiene latex, and an anionic flocculant is added (typically this has a relatively high molecular weight and a relatively low charge density). A cationic flocculant (typically having a relatively high molecular weight and a relatively low charge density) or a cationic coagulant (typically having a relatively low molecular weight and relatively high charge density) is then added to enhance the stability of the initial agglomerate. This enhancement probably results from reaction or interaction between the cationic flocculant or coagulant on the one hand and the anionic flocculant and the latex (also anionic) on the other. However, we do not wish to be bound by any particular theory as to the processes involved. The papermaking fibre content of the aqueous suspension prior to the anionic flocculant addition is typically from 1.5% to 3% by weight.

Although the mixing sequence and order of addition just described is currently considered to be preferred, it will be appreciated that the key point is the formation of adequately stable fibre/pigment agglomerates, and that the precise sequence of mixing and addition of raw materials which achieves this is secondary. However, we have found that although satisfactory agglomerates can be formed when cationic flocculant or coagulant is added prior to addition of anionic flocculant, the agglomerate formation is more difficult to control and is not always achieved satisfactorily. This sequence of addition is therefore not preferred. We have also found that addition of pigment after the agglomerating agent(s) have been added tends to lead to formation of pigment lumps, which is undesirable. Although the use of a latex or alternative binder is currently considered highly desirable, papermaking fibre and pigment can be flocculated in the absence of latex or other binder, and suitably stable agglomerates obtained in this way can be used in the present process. Our experience is that the aesthetic effect obtained in the final product is less attractive when no latex or other binder is present. When latex is used, the amount is typically about 20%, based on the weight of dry latex to weight of dry fibre in the speckle-forming mixture.

The types of fibre used for producing speckle-forming material by the Process Variant A route can vary quite widely, but a significant proportion of relatively long softwood fibres is desirable in order to enhance the cohesion or tangled character of the fibre/pigment agglomerate formed. We have found that a 50/50 blend of hardwood and softwood fibres gives good results, but this precise ratio is not critical, although when agglomerates were made with a 70/30 hardwood/softwood blend, they were less satisfactory than those obtained with higher proportions of softwood fibres.

The pigment used, in the case of white speckles formed by the Process Variant A route, is preferably titanium dioxide, since this imparts a high degree of both opacity and whiteness. However, other white pigments can be used, for example barium sulphate in the form of blanc fixe or baryta; calcium sulphate in the form of gypsum or anhydrite; kaolin; or, if neutral- or alkaline-sizing is used in the papermaking operation, chalk or precipitated calcium carbonate. The amount of pigment present in the speckle-forming stock can vary widely, depending on the aesthetic effect desired. We have successfully used titanium dioxide in amounts of from below 25% to approaching 150% (specifically from 24% to 143%) based on the total dry weight of fibre in the speckle-forming mixture.

The amount of agglomerating agent(s) to be used can also vary quite widely, for example from about 0.2% to about 1.0% by weight, based on the dry weight of fibres in the speckle-forming mixture (these figures apply to each agglomerating agent when both cationic and anionic agents are used). These agents are used in solution and the concentration of this solution affects the agglomerating action. We have so far found concentrations of the order of 0.5 to 0.75% by weight to be most satisfactory. Concentrations of 1% were less satisfactory as large clumps of fibre and pigment were mainly formed, with few smaller agglomerates—this was found to detract from the aesthetic effect achieved. The solutions of agglomerating agent should be used soon after being made up, say within about 1 hour, as otherwise their agglomerating action may deteriorate. Addition of the agglomerating agent solutions should be carried out quickly, preferably within a period of well below two minutes and ideally over a period of less than about 30 seconds, as otherwise the agglomerating action is less effective (although this may depend on the particular chemical being used).

The mixture of fibre, pigment and latex, when present, is normally kept stirring during at least part of the agglomeration stage of the process. The intensity and duration of this stirring influences the size and shape of the agglomerates obtained and hence affords a degree of control over the appearance of the final paper product.

In the case of Process Variant B, dry comminution can be achieved using conventional granulators, disintegrators or disc grinders, such as are available from a variety of machinery makers, or by employing refiners as used in the paper industry for stock preparation, but in a "dry" mode, as opposed to the normal aqueous suspension mode. In general, granulators and disintegrators were found to give speckles with sharper edges than disc grinders or dry refining. Sharper edges generally give rise to a more attractive aesthetic effect.

It will be appreciated that the term "dry comminution" as used in this specification does necessarily not mean bone dry, but merely dry in the sense of not being in aqueous suspension or saturated with water.

The duration of the dry comminution treatment, the type of comminution equipment used, and the nature of the starting paper or other fibre aggregate all influence the size of the speckle-forming material obtained. More precise size control, if needed, can be achieved through the use of mesh screens, for example 1, 2, 3 or 4 mm mesh screens.

Paper is the preferred starting material for dry comminution into speckle-forming material. It can be white or coloured, depending on the decorative effect desired in the final product, for example white on a coloured background, or coloured on a white or contrasting colour background. Suitable papers for comminution include blade-coated art paper, white opaque board, white high wet strength paper, and coloured card, for example red card as commonly used in Christmas cards.

When clumps of fibre are used as the starting material for dry comminution, the fibres are preferably of a strong nature, for example abaca fibres, (also known as Manila hemp), or other hemp fibres. Disc grinding of abaca fibre clumps broken from a pulp bale produced speckle-forming material of an elongated shape which proved particularly attractive in the finished paper.

The amount of speckle-forming material to be added to the papermaking furnish is determined both by the aesthetic effect desired and the process variant used to produce the speckle-forming material. In the case of Process Variant A, the speckle-forming material is added typically at a level of about 10 to 20% of the final paper (based on dry weight of speckles to dry weight of the fibre and filler in the main furnish). The proportion of visible speckles in the final paper is less than this, as not all the fibres in the fibre/pigment mixture become incorporated in agglomerates. Hence they become effectively invisible constituents of the final paper product.

In the case of Process Variant B, the speckle-forming material is conveniently added in the form of an aqueous suspension of about 1.5 to 3% concentration by weight. The addition level is chosen such as to give a speckle content in the final paper of about 5 to 15% (based on dry weight of speckles to dry weight of the fibre and filler in the main furnish).

Regardless of the Process Variant used to produce the speckle-forming material, the papermaking furnish to which the speckle-forming material is added is generally conventional in nature, and typically comprises a blend of hardwood and softwood pulps. It may include a major proportion of recycled fibre.

In a typical production operation, given by way of example only, a 70% hardwood/30% softwood fibre stock is prepared in conventional manner in a pulper at about 5 to 6% consistency and subjected to conventional refining. Dye fixing agent is added, followed later by dyes and internal sizing agent (e.g. alkyl ketene dimer). The stock is then pumped to a header tank. A chalk loading can be added between the header tank and fan pump, prior to conventional stock cleaning. The speckle stock is then added to the furnish at a point just prior to the headbox, typically at additional levels already referred to. The resulting speckle stock/furnish mixture is then projected on to the papermaking wire from the headbox slice and paper is produced in the normal way to give a product having sharply defined speckles of varying dimensions against a continuous contrasting background.

The invention will now be illustrated by the following Examples, in which all parts and percentages are by weight unless otherwise stated:

EXAMPLE 1

This illustrates the manufacture of approximately one tonne of patterned paper using Process Variant A.

a) Preparation of Speckle Stock

A pulper of capacity c. 14200 liters was approximately three-quarter filled with water. 86 Kg of c.10% moisture content eucalyptus pulp, 86 Kg of c.10% moisture content softwood kraft pulp and 75 Kg titanium dioxide were added with normal mixing agitation. The fibre consistency was then adjusted to about 1.5% by the addition of further water. The resulting aqueous dispersion was then pumped to a larger chest, and 29 Kg of 50% solids content styrene-acrylic latex ("ACRONAL S360D"* supplied by BASF, and stated by the suppliers to be a copolymer based on n-butyl acrylate, acrylonitrile and styrene) were added with normal agitation. 120 liters of a 0.75% solution of high molecular weight anionic flocculant ("NALCO A626"* supplied by Nalco Chemical Company were added batchwise from a bucket over a target period about 30 seconds. After around 5 to 10 minutes, 120 liters of 0.75% solution of high molecular weight cationic polyelectrolyte flocculant ("NALCO 4634-SC"* also supplied by Nalco Chemical Company) were added in the same manner. Agglomerated clumps of latex-bound fibre and filler were seen to begin forming immediately.

* ACRONAL and NALCO are trade marks.

b) Preparation of Main Furnish

A 70% hardwood/30% softwood fibre stock was prepared in conventional manner in a pulper at about 5 to 6% consistency and subjected to conventional refining. Dye fixing agent was added, followed later by dyes and internal sizing agent (alkyl ketene dimer). The dyes chosen were such as to produce a grey shade in the final paper. The stock was then pumped to a header tank. A chalk loading was added between the header tank and fan pump, prior to conventional stock cleaning.

c) Preparation of Patterned Paper

The speckle stock from (a) above was added to the furnish from (b) above at a point just prior to the headbox at an addition level of about 10 to 20% (based on dry weight of fibre and pigment in the speckles to dry weight of the remaining fibre and filler in the furnish). The resulting speckle stock/furnish mixture was then projected on to the papermaking wire from the headbox slice and paper was produced in the normal way. It had sharply defined white speckles of generally fibrous appearance but varying dimensions against a continuous grey background.

EXAMPLE 2

This illustrates, on a laboratory scale, a process similar to that of Example 1 but in which the fibre consistency in the speckle-forming operation is 3%.

35 ml of 3% hardwood pulp suspension and 35 ml of 3% softwood pulp suspension were first mixed (total dry fibre weight of 2.1 g). 0.8 ml of 50% solids content styrene-acrylic latex ("ACRONAL S360D") and 1 g of titanium dioxide were added and the mixture was stirred for 5 minutes. 12 ml of 0.1% anionic flocculant ("NALCO A626") were added over a period of about 20 to 30 seconds, and the mixture was stirred for a further 5 minutes. 12 ml of 0.1% cationic flocculant ("NALCO 4634-SC") were then added over a period of 20 to 30 seconds. Clumps of entangled fibre and pigment were seen to start forming immediately. The resulting mixture was then added to 450 ml of 1.5% consistency 50/50 hardwood/softwood fibre blend which had been previously dyed grey and fixed. Approximately 100 $gm^{-2}$ handsheets were produced using a British Standard Sheet Making machine. The resulting sheet had a random pattern of white speckles on a grey background.

EXAMPLE 3

This illustrates the production of white-speckled grey papers using Process Variant A and a variety of relative proportions and types of raw materials in the speckle-forming process. 50 ml of 3% hardwood fibre stock and 20 ml of 3% softwood fibre stock were mixed and 1.5 g titanium dioxide pigment were added with stirring, followed by 50 ml water. 0.4 g of styrene-acrylic latex ("ACRONAL S360D") were added, followed by 2 ml of 0.1% solution of anionic flocculant ("NALCO A626"). After stirring for 5 minutes, 2 ml of 0.1% cationic flocculant ("NALCO 4634-SC") were added, resulting in formation of entangled fibre/pigment agglomerates.

These agglomerates were filtered off and then re-dispersed in water to give a total volume of dispersion of 200 ml. 20 to 40 ml additions of the resulting speckle-forming stock were added to 100 ml portions of previously dyed and fixed grey 1.5% papermaking stock and made into handsheets, generally as described in Example 2. The handsheets exhibited white speckles against a grey background.

In variants of the above procedure, the following changes were made, either separately or in combination:

a) amount of titanium dioxide (1 g and 0.5 g additions instead of 1.5 g)
b) amount of speckle-forming stock added (50 ml instead of 20 to 40 ml)
c) amount of flocculants added (two or three times as much of each, and/or 1.5 times as much anionic flocculant used as cationic, or vice versa, instead of the same amounts)
d) titanium dioxide was added after instead of before the flocculants
e) styrene-butadiene latex ("DL950" supplied by Dow Chemical) used instead of styrene-acrylic latex
f) mixing times varied
g) latex amount varied (0.2 ml instead of 0.4 ml)
h) blanc fixe or kaolin used instead of titanium dioxide
i) latex omitted altogether
j) flocculant concentration increased (1%, 0.75% and 0.5% instead of 0.1%)
k) speckle-stock fibre dispersion consistency reduced (1.5% instead of 3%).

Speckled paper was obtained in all cases, but the size and appearance of the speckles in the paper varied considerably.

EXAMPLE 4

This further illustrates the production of speckle-patterned paper on a full-size papermachine using Process Variant A.

344 Kg of c. 10% moisture content softwood kraft pulp were added to c. 10,600 liters of fresh water in a pulper and the mixture was stirred until the pulp had fully disintegrated. 60 Kg of styrene-acrylic latex ("ACRONAL S360D") were then added, whilst maintaining stirring. This represented c. 9.7% latex on a dry basis, based on dry fibre content. 125 Kg titanium dioxide were than added, still with stirring, and the mixture was pumped to a mixing chest, where agitation was continued. 404 liters of a 0.5% solution of anionic flocculant ("NALCO A626") were pumped in, after which agitation was continued for a further 10 to 15 minutes before being stopped (or, in a repeat run, slowed down). 404 liters of a 0.75% solution of cationic flocculant ("NALCO 4634-SC") were then added by means of a bucket (or, in a repeat run, pumped in). Full agitation was then resumed, and was continued for 10 to 15 minutes. 200 liters of a 25% aqueous talc dispersion were then added to counteract any tendency for polymeric deposits to form on the paper machine at a later stage. The mixture was then pumped to a header tank by means of a relatively low shear pump. The subsequent procedure was then generally as described in Example 1, except that the main furnish was blue rather than grey. The final paper was thus blue with white speckles.

In a further repeat run, 225 Kg of titanium dioxide were used, in order to achieve speckles of a different appearance.

EXAMPLE 5

This illustrates the use of different anionic and cationic flocculants from those used in previous Examples.

0.8 ml of 50% solids content styrene-acrylic lated ("ACRONAL S360D") was added to 140 ml of 3% softwood pulp suspension, and the mixture was stirred rapidly (1300 rpm). 1.34 g of titanium dioxide were added and stirring was continued at the same speed for a further 5 minutes. 5.5 ml of 0.5% high molecular weight medium anionic acrylamide copolymer flocculant ("POLYPLUS 430" supplied by Betz Limited of Winsford, Cheshire, Great Britain) were then added, and stirring was continued at 1300 rpm for a further 5 minutes. 5.5 ml of 0.75% moderate molecular weight high cationic charge density polyacrylamide flocculant emulsion ("POLYMER 1268L", also supplied by Betz Limited) were then added, and the mixture was stirred less rapidly (200 rpm) for 1 minute. 2.3 g of 30% aqueous talc suspension were then added and stirring was continued for one minute. Fibre/pigment agglomerates were seen to have formed, and these were incorporated into handsheets, generally as described in Example 2. The resulting sheet had a random pattern of elongate white speckles on a coloured background.

EXAMPLE 6

This illustrates the production of speckle-pattern paper on a laboratory scale, using Process Variant B.

Dye fixing agent was added to 400 ml of a 1.5% consistency hardwood stock and the mixture was stirred for 10 minutes. A blend of dyes such as to produce a grey shade was then added and the mixture was stirred for a further 10 minutes. 0.3 g of paper speckles produced by dry comminution of A4 size blade-coated art paper sheets in a Blackfriars Granulator (product of Blackfriars Limited, Market Harborough, Leicestershire, England) were then added, giving a furnish comprising c. 95% hardwood and 5% speckles, and c. 100 $gm^{-2}$ handsheets were then produced using a British Standard Sheet Making machine. The resulting sheet had a random pattern of white speckles on a grey background.

The procedure was then repeated using a variety of different coloured paper furnishes and speckles derived by dry comminution of a variety of types of paper and of clumps of abaca fibres. A disc grinder was used for making certain of the speckles, instead of a granulator. The resulting papers had a random speckle pattern on a contrasting colour background.

What is claimed is:

1. A patterned paper not saturated with latex comprising the white- or color-speckled effect of a paper prepared by a process wherein (1) a speckle-forming material is prepared by agglomerating a mixture comprising papermaking fibre, particulate pigment, and a latex or other binder in an amount of up to about 20% by weight, based on the weight of dry latex or other binder to weight of dry fibre in the speckle-forming mixture, by the addition to the mixture of at least one polyelectrolyte flocculant, polyelectrolyte coagulant or other organic polyelectrolyte agglomerating agent; (2) the resulting speckle-forming material is introduced into a papermaking furnish having fibres of contrasting colour to the colour of the speckle-forming material and in which dye, if present, has been fully fixed; and (3) the speckle-containing furnish is drained to produce a patterned paper web not saturated with latex.

2. A patterned paper comprising the white- or color-speckled effect, in which speckles are sharp and well defined and are of random size and shape, of a paper prepared by a process wherein (1) a speckle-forming material is prepared by dry comminution of paper or clumps of entangled cellulose pulp fibres; (2) the resulting speckle-forming material is introduced into a papermaking furnish having fibres of a contrasting colour to the colour of the speckle-forming material and in which dye, if present. has been fully fixed; and (3) the speckle-containing furnish is drained to produce a patterned paper web.

3. A speckle patterned paper comprising speckles of dry comminuted paper or clumps of entangled cellulose pulp fibres, said speckles contrasting in color with the remainder of the paper and providing a white- or color-speckled effect, being sharp and well defined, and being of random size and shape.

4. A speckle patterned paper according to claim 3, wherein the speckles are derived from dry comminuted coated paper.

* * * * *